United States Patent [19]

Kirkham, Jr.

[11] Patent Number: 4,466,124

[45] Date of Patent: Aug. 14, 1984

[54] BACKPACK AND SLEEPING BAG SYSTEM

[76] Inventor: Arthur J. Kirkham, Jr., 9381 Peacock Dr., Sandy, Utah 84070

[21] Appl. No.: 404,041

[22] Filed: Aug. 2, 1982

[51] Int. Cl.[3] ..... B65D 30/10; A45F 3/04

[52] U.S. Cl. ..... 383/2; 224/153; 383/120

[58] Field of Search ..... 150/52 R, 52 E, 1.7; 190/41 Z, 60; 224/153, 209, 211, 202, 205, 215; 135/33; 2/69.5, 275; D2/267; 36/2 R, 1.5; 383/2, 120

[56] References Cited

U.S. PATENT DOCUMENTS

| | | | |
|---|---|---|---|
| 206,976 | 8/1878 | Sands | 150/52 R |
| 4,081,061 | 3/1978 | Tucker | 190/60 |
| 4,096,978 | 6/1978 | Noice | 224/215 |

FOREIGN PATENT DOCUMENTS

| | | | |
|---|---|---|---|
| 167940 | 8/1950 | Fed. Rep. of Germany | 224/917 |
| 951179 | 9/1949 | France | 383/907 |
| 129795 | 7/1919 | United Kingdom | 224/209 |

*Primary Examiner*—Steven M. Pollard
*Assistant Examiner*—David Voorhees
*Attorney, Agent, or Firm*—B. Deon Criddle

[57] ABSTRACT

A backpack and sleeping bag system comprised of a backpack of generally "delta" or trapezoidal configuration and an expandable diameter, elongate bag that is used to contain a sleeping bag of various conventional means.

The backpack is comprised of two generally trapezoidal front and back panels, two side panels, a bottom panel, and a top panel arranged in a flap configuration. Integral to the main body of the back pack are metal snap fasteners which allow two pockets to be attached to either the back or side panels of the main body.

2 Claims, 6 Drawing Figures

BACKPACK AND SLEEPING BAG SYSTEM

BACKGROUND OF THE INVENTION

1. Field of the Invention

The present invention relates to camping equipment and particularly to backpacks and devices used for carrying sleeping bags.

2. Prior Art

Backpacks for use in carrying equipment have been in existence for a great length of time. Generally speaking, backpacks can be divided into two categories. One category comprises backpacks which have an integral frame or in which a frame is used in conjunction therewith. The frames are usually made of a metal such as aluminum. The other category of backpacks comprise the so-called frameless packs available in a wide variety of configurations.

Backpacks of the first category are often used for carrying very high weight loads and are more expensive than frameless backpacks of the second category. Backpacks comprising a frame can be uncomfortable to wear and awkward to use because of the large number of parts associated with the frame and the adjustments needed to insure proper positioning of the backpack and distribution of the load being carried.

Frameless backpacks are often cumbersome due in part to the difficulty in maintaining proper weight distribution. Such backpacks are, thus, often small and are used to carry only light loads. The weight and size limitations incurred with frameless packs become a significant consideration when the pack is to be used by overnight campers. A sleeping bag, which must be accomodated by an overnight camper, may take up much valuable space in the pack, and this limits the amount of other equipment and supplies that can be taken on a trip. Accordingly, it is desirable to have available a relatively inexpensive frameless pack that is designed in such a way that it can accomodate the needs of a day camper as well as being adaptable to carrying a sleeping bag and other equipment needed by the overnight camper.

OBJECTS OF THE INVENTION

It is a principal object of the present invention to provide a frameless backpack.

Another object of the present invention is provide a frameless backpack which readily accomodates a sleeping bag such that the apparatus is adaptable for use in either day camping or overnight camping.

Still another object of the present invention is to provide a frameless backpack having removable pockets which can be attached at several positions for use in carrying various items.

Yet another object of the present invention is to provide a frameless backpack having sufficient support to maintain its general shape without the need for auxiliary apparatus.

A still further object of the invention is to provide a novel storage and stuff sack which can be used to compress a bed roll or sleeping bag into a compact, tight, elongate roll which can be readily attached to a backpack, and which, alternatively, can be used in its expanded condition as an enlarged storage sack.

PRINCIPAL FEATURES OF THE INVENTION

Principal features of the invention include a frameless backpack constructed in a trapezoidal or "delta" configuration and an elongate bag which is adapted to carry a bed roll, sleeping bar or other similar items. The bag has openings at both ends which can be closed by drawstrings in a conventional manner.

The trapezoidal shape of the pack with the narrower width at the top allows the elongate bag to be attached to the perimeter of the pack in an inverted "U" configuration with the two ends of the bag extending substantially down the side length of the pack.

The pack comprises two panels, each having a generally trapezoidal shape. One panel, which for purposes of description is referred to herein as the back panel, has a panel of padding attached thereto as an integral part thereof. The panel of padding is superimposed upon the interior surface of the back panel to insure comfort to the wearer and provide an additional barrier—other than fabric of the back panel itself—between the contents of the pack and the wearer. The front panel of the pack is generally trapezoidal in shape to correspond with the back panel.

The lateral sides and the top of the pack are formed from a strip of fabric sewn along one of its side edges to the side and top edges of the back panel. The bottom panel of the pack is formed from a piece of fabric which is attached to the front, rear, and side panels. On the side panels and on the front panel are sets of metal fasteners which allow for the securing of generally rectangular pockets. The front panel is attached along its sides and top to the side edges of the lateral sides of the pack with a zipper, whereby access to the inside of the pack is gained by disconnecting the zipper and folding the front panel downwardly from the pack.

The elongate bag is preferably made of a nylon fabric formed into a cylinder with openings at each end. Each end contains a hollow sleeve-like perimeter stitching with an interior drawstring which is a well-known closure system. The bag has a full-length breathing panel and a full-length zipper, with the rows of engaging teeth running the entire length of each outer side of the breathing panel. The bag is adapted to receive longitudinally therewithin a bed roll or sleeping bag. The bed roll or sleeping bag is held in a compact roll by engaging the zipper along the length of the elongate bag. With the zipper disengaged and the breathing panel expanded so as to form a part of the exterior surface of the bag, the bag can conveniently be used as an expanded storage bag.

The pack has attached to the side and top panels, several securing straps utilizing a type of quick release buckle known by the trademark name "Fastex". These straps are used in securing the elongate bag with the sleeping bag or bed roll contained therein to the pack along the sides and top of the pack. The pack body also has several diamond-shaped patches which contain slots and may be used in conjunction with additional straps for securing outdoor equipment of various types to the exterior of the pack.

Other objects and features of the invention will become apparent from the following detailed description and drawing disclosing what are presently contemplated as being the best modes of the invention.

THE DRAWING

In the drawing:

FIG. 1 is a perspective view of the frameless pack in accordance with this invention;

FIG. 2, a rear elevation view of the frameless pack;

FIG. 3, a perspective view of the elongate bag used to carry a bed roll or sleeping bag;

DETAILED DESCRIPTION OF THE DRAWING

Figure 1:
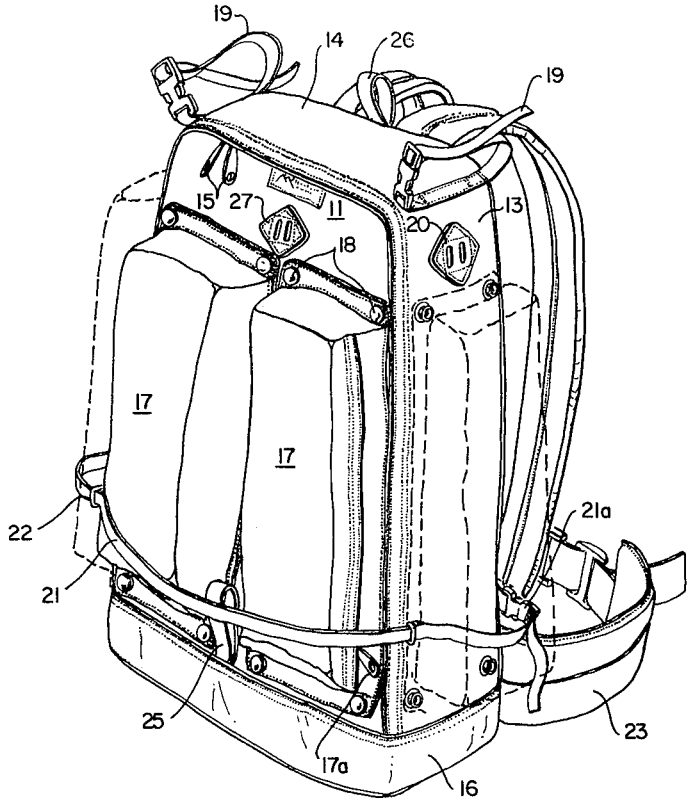
Figure 2:
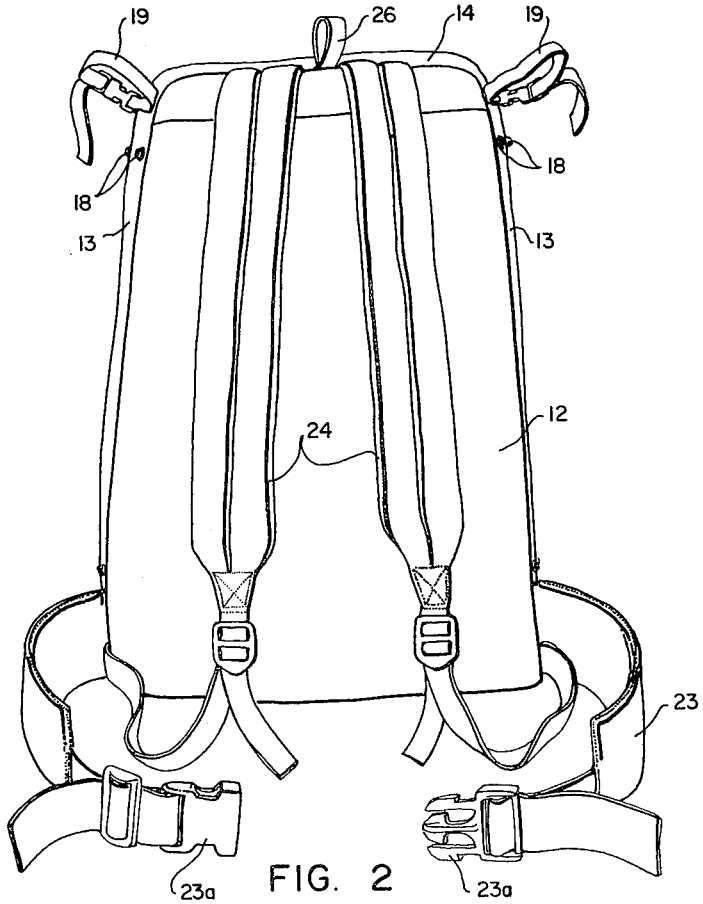

Referring now to the drawings:

A referred embodiment of the backpack apparatus of the present invention is shown in FIG. 1. The main body of the pack is comprised of front panel 11 and rear panel 12, both of which are of a generally "delta" or trapezoidal shape, i.e., the top is narrower than the bottom and the sides slope inwardly from the bottom to the top. Side panels 13 and top panel 14 of the pack are formed by an integral, elongate section of fabric to which is attached rear panel 12 by conventional stitching. Front panel 11 attaches to the sides 13 and top 14 of the pack by two conventional zippers 15 that utilize a common track.

The bottom panel 16 of the pack 10 can have the shape of a shallow pouch, i.e., a generally concave section of fabric. The bottom panel 16 is sewn to the front, rear and side panels in a conventional manner.

Figure 6:
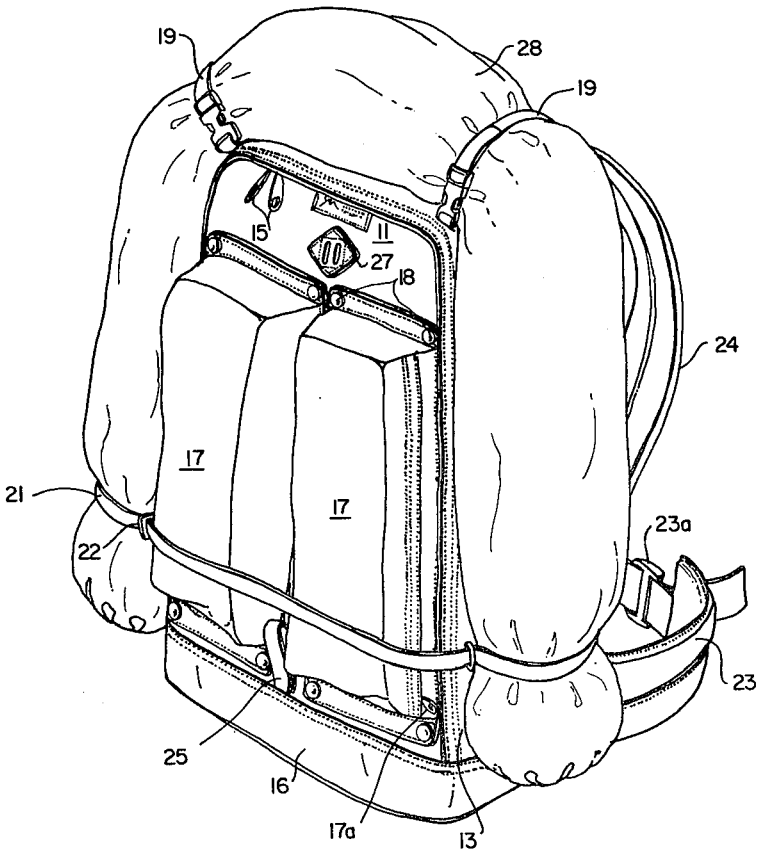
FIG. 6, a perspective view of the backpack system.

Pockets 17, which may be attached to the front panel 11 or side panels 13 (dotted lines in FIG. 1) are generally rectangular in shape and are secured by metal fasteners 18. By disconnecting the fasteners 18, the pockets can be removed entirely from the pack. The pockets 17 are generally rectangular envelopes, with the interior space therein being defined by a back panel, a front covering which also forms the lateral sides of the pocket, and end panels. The metal fasteners 18 are attached at the corners of the back panel of the pocket 17 to allow the pocket 17 to be attached to the pack as shown in FIG. 6. Zipper 17*a* runs the longitudinal length of the pocket to provide access therewithin. Cooperating members for the metal fasteners 18 are provided on the front panel 11 and the side panels 13 of the pack. When the pack is used in combination with the bed roll or sleeping bag carrying component as described fully hereinafter, the pockets 17 are conveniently attached to the front panel 11 of the pack. When the pack is used without the bed roll or sleeping bag carrying component, the pockets 17 can be attached to either the front panel 11 or side panels 13 at the convenience of the person wearing the pack.

Straps 19 are provided at the top corners of the pack and are conventional in construction. The straps 19 are secured together by a quick release belt buckle fastener that is known by the trademark "Fastex". The straps 19 are attached to the pack at a location which, for descriptive purposes, defines the boundary between the top panel 14 and the two sides panels 13. The straps are so located so as to allow them to be used for securing equipment carried horizontally across the top panel 14 or to be used to secure equipment, such as skis that are carried vertically parallel to the side panels 13. Although not illustrated, when the straps 19 are not being used to secure items to the pack, they can be crisscrossed and attached to each other to provide a handy carrying loop for hand carrying the pack.

To enable heavy loads to be carried vertically, patches 20 are attached near the upper portion of the side panels 13. The patches are of conventional design and are used with auxiliary straps (not shown).

The flexible nature of the material used in the construction of the side panels 13 and the pockets 17 allow equipment such as skis to be carried vertically utilizing straps 19 (and/or auxiliary straps with patches 20) even when pockets 17 are attached to the side panels 13 because a moderate amount of space will exist between side panels 13 and pockets 17.

Strap 21 is attached by means of a conventional loop buckle 21*a* at each end of the seam between the rear 12 and side 13 panels and passes through guide loops 22 mounted on the side panels 13. The strap 21 can be used in connection with straps 19 to secure equipment to the side panels 13 of the pack. The strap 21 also serves as a compression strap to relieve tension on the zippers 15 from the load being carried in the pack.

The pack is secured to the wearer by way of an adjustable padded waist belt 23 and adjustable padded shoulder straps 24. In the preferred embodiment of the invention, the waist belt 23 employs a "Fastex" buckle 23*a* as a fastening device.

Loop 25, attached to the bottom of the front panel 11, and loop 26, attached to the top of rear panel 12 may be used for carrying equipment. Loop 25 may also be used in conjunction with patch 27 mounted at the top of front panel 11.

It is, of course, understood that a plurality of strap patches could be attached to the surface of the pack and that the number and location of strap patches utilized in the preferred embodiment does not limit the scope of the invention as otherwise defined by the claims hereto.

Figure 3:
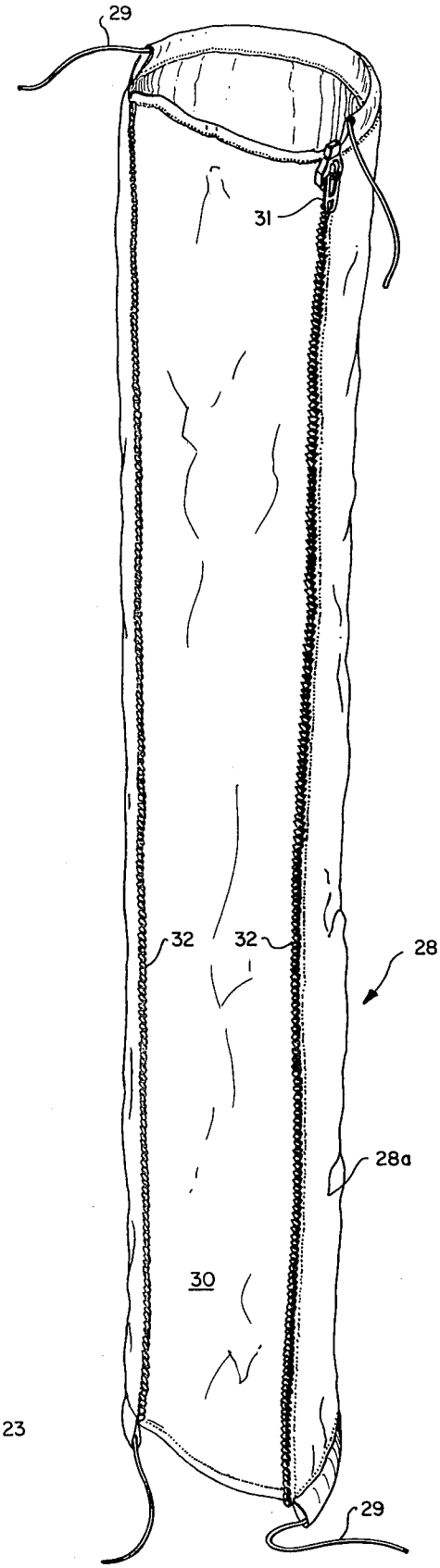

The sleeping bag carrying system component of the present invention, FIG. 3, is comprised of an elongate bag 28 of suitable flexible material with drawstring closures 29 of conventional construction located at each end of the bag 28.

Breathing panel 30 extends the length of the bag 28 and is sewn in by conventional means. Zipper 31 is attached to the edges 32 of the main body 28*a* of bag 28 in such a manner that when zipper 21 is secured, the breathing panel 30 is folded in the interior of the main body 28*a* of the bag 28. It can be seen, with reference to FIG. 3, that the effect of the zipper 31 being closed outside of the breathing panel 30 results in bag 28 having a variable diameter. In effect, breathing panel 30 is an arc of the circumference of the bag 28, and the closing of the zipper 31 will reduce the circumference of the bag by an amount equal to the transverse width of the panel 30. Such a reduction in the circumference will of course reduce the usable diameter of the bag 28.

Figure 4:
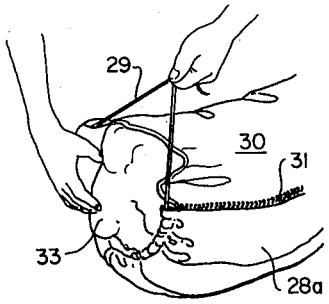
FIG. 4, is a perspective view of the elongate bag illustrating the insertion of a sleeping bag.
Figure 5:
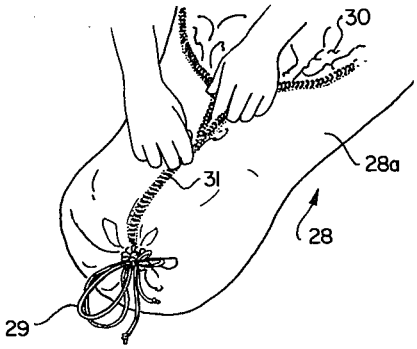
FIG. 5 is a perspective view of the elongate bag illustrating the closing of the filled bag.

The insertion of a sleeping bag 33 into the bag 28 is illustrated in FIGS. 4 and 5. The sleeping bag 33 is stuffed into the bag 28 (FIG. 4) and one drawstring 29 is drawn and tied (FIG. 5). The bag 28 is then secured by closing zipper 31 through its entire length.

Once the bag 28 is closed it can be mounted on the backpack as shown in FIG. 6. One end of the bag 28 is inserted through one side of strap 21 between the loop buckle 21*a* and guide loop 22. The bag 28 is then wrapped over the top of the pack and secured by the other section of strap 21. The bag 28 is then secured against the top panel 14 by utilizing straps 19. As can be seen, the trapezoidal configuration of the pack allows for easy attachment of the bag 28 because the bag 28 does not have to be folded at a right angle at the location of straps 19. The folding of bag 28 when containing a sleeping bag would be most difficult and result in a constant force that might result in the ends of the bag 28 slipping upward and out of strap 21. In the absence of a trapezoidal configuration, additional means would probably be necessary to secure the bag 28 to the pack. Such additional securing means would be cumbersome and add to the cost of the system.

Although a preferred form of my invention has been herein disclosed, it is to be understood that the present disclosure is by way of example and that variations are possible without departing from the subject matter coming within the scope of the following claims, which subject matter I regard as my invention.

I claim:

1. An expandable storage bag comprising an elongate, cylindrical body made of a flexible material;

drawstrings at the opposite ends of said body; and a zipper having two rows of engaging teeth extending in parallel spaced configuration along the length of said body, whereby when the rows of teeth of the zipper are disengaged, the body of the bag can expand to its full size with the material between the rows of the zipper forming a part of the exterior surface of the bag, and when the rows of teeth are engaged, the circumference of the bag is reduced and the material between the rows of teeth of the zipper is folded within the interior of the bag.

2. A backpack assembly comprising a main body having front and rear panels of generally trapezoidal shape;

a top panel, bottom panel and two side panels attached to said front and rear panels in a manner defining a closed interior space;

means for providing access to said interior space;

at least two upper straps having adjustable length attached to said main body on said top panel thereof;

a lower strap of adjustable length attached at its respective ends to opposite side edges of said rear panel;

a pair of guide loops attached to the respective side panels so that said lower strap passes from its attachment at one side of said rear panel through a guide loop on the corresponding side panel, then around the front panel, through the guide loop on the other side panel to the attachment of the lower strap to the other side of said rear panel;

at least one pocket removably attachable to said front panel or said side panels;

an elongate bag of suitable flexible material and of generally cylindrical shape and open at each end;

means for releasably closing the open ends of said elongate bag;

a breathing panel attached longitudinally along the length of said elongate bag, wherein the breathing panel comprises a longitudinal segment of the cylindrical surface of said elongate bag; and slide fastener means for longitudinally attaching together that part of the material of said elongate bag immediately adjacent the longitudinal sides of said breathing panel in a manner such that said breathing panel is positioned within the interior space of said elongate bag when the slide fastener is engaged, whereby a sleeping bag, bed roll or other compactable item can be inserted in an open end of said elongate bag, the elongate bag and its contents can be compacted by engaging the slide fastener on said elongate bag, and the compacted elongate bag can be formed in a generally inverted U-shape over the top panel and down along the side panels of said backpack, with the lower ends of the elongate bag being secured to the sides of said backpack with said lower strap on said backpack and with the midportion of the elongate bag being secured at the top of said backpack with said upper straps on said backpack.

* * * * *